US008994602B2

(12) United States Patent
Plet et al.

(10) Patent No.: US 8,994,602 B2
(45) Date of Patent: Mar. 31, 2015

(54) DUAL-POLARIZATION RADIATING ELEMENT FOR BROADBAND ANTENNA

(75) Inventors: Jérôme Plet, Lannion (FR); Nicolas Cojean, Lannion (FR); Jean-Pierre Harel, Lannion (FR)

(73) Assignee: Alcatel Lucent, Boulogne-Billancourt (FR)

( * ) Notice: Subject to any disclaimer, the term of this patent is extended or adjusted under 35 U.S.C. 154(b) by 928 days.

(21) Appl. No.: 13/132,560

(22) PCT Filed: Dec. 9, 2009

(86) PCT No.: PCT/FR2009/052467
§ 371 (c)(1),
(2), (4) Date: Aug. 29, 2011

(87) PCT Pub. No.: WO2010/067022
PCT Pub. Date: Jun. 17, 2010

(65) Prior Publication Data

US 2011/0298682 A1 Dec. 8, 2011

(30) Foreign Application Priority Data

Dec. 10, 2008 (FR) ..... 08 58425

(51) Int. Cl.

| | |
|---|---|
| ***H01Q 21/26*** | (2006.01) |
| ***H01Q 1/24*** | (2006.01) |
| ***H01Q 5/00*** | (2006.01) |
| ***H01Q 9/28*** | (2006.01) |
| ***H01Q 19/30*** | (2006.01) |

(Continued)

(52) U.S. Cl.
CPC ..... *H01Q 21/24* (2013.01); *H01Q 1/246* (2013.01); *H01Q 5/00* (2013.01); *H01Q 5/40* (2013.01); *H01Q 9/28* (2013.01); *H01Q 19/30* (2013.01); *H01Q 21/06* (2013.01); *H01Q 21/26* (2013.01); *Y10T 29/49016* (2015.01)
USPC ..... 343/797; 353/795

(58) Field of Classification Search
USPC ..... 343/797, 795, 807, 730, 798, 810, 846
See application file for complete search history.

(56) References Cited

U.S. PATENT DOCUMENTS

| | | | |
|---|---|---|---|
| 4,668,956 | A | 5/1987 | Mahnad |
| 5,418,544 | A | 5/1995 | Elliot |

(Continued)

FOREIGN PATENT DOCUMENTS

| | | |
|---|---|---|
| CN | 1638192 | 7/2005 |
| JP | 2008-011499 | 1/2008 |

(Continued)

OTHER PUBLICATIONS

International Search Report for PCT/FR2009/052467 dated Jun. 2, 2010.

*Primary Examiner* — Karl D Frech
(74) *Attorney, Agent, or Firm* — Fay Sharpe LLP

(57) ABSTRACT

A radiating element of a broadband antenna comprises a foot supporting first and second components disposed in a first plane which are two half-wavelength symmetrically fed dipoles generating a linear dual polarization, both comprising two arms. According to the invention, the radiating element further comprises at least one third component chosen from among a dipole or a patch disposed within a second plane placed above the first plane, and each of the components is made up of a volume fractal pattern.

10 Claims, 4 Drawing Sheets

Figure 1:
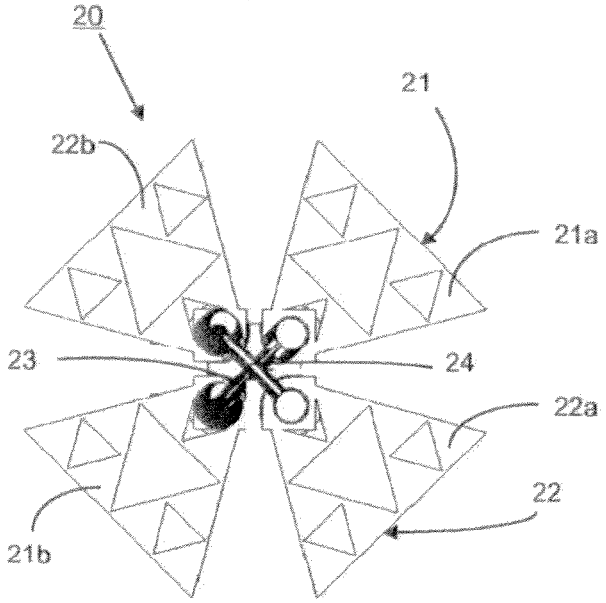

(51) Int. Cl.
*H01Q 21/06* (2006.01)
*H01Q 21/24* (2006.01)

(56) References Cited

U.S. PATENT DOCUMENTS

| | | | | |
|---|---|---|---|---|
| 6,342,867 | B1 | 1/2002 | Bell | |
| 7,106,258 | B2 | 9/2006 | Kuramoto | |
| 7,362,281 | B2 | 4/2008 | Huang et al. | |
| 8,581,801 | B2 * | 11/2013 | Puzella et al. | 343/878 |
| 2005/0140553 | A1 | 6/2005 | Kuramoto | |
| 2006/0170604 | A1 | 8/2006 | Almog et al. | |
| 2007/0067058 | A1 | 3/2007 | Miyamoto et al. | |
| 2007/0194992 | A1 | 8/2007 | Puente Baliarda et al. | |
| 2008/0001838 | A1 | 1/2008 | Huang et al. | |

FOREIGN PATENT DOCUMENTS

| | | | |
|---|---|---|---|
| WO | WO 01/76012 | | 10/2001 |
| WO | WO 03/103086 | A2 | 12/2003 |
| WO | 2004/010535 | | 1/2004 |
| WO | WO 2007/042938 | A2 | 4/2007 |

* cited by examiner

DUAL-POLARIZATION RADIATING ELEMENT FOR BROADBAND ANTENNA

The present invention pertains to any broadband antenna comprising radiating elements that may particularly be used in base stations of cellular radio communication networks. It further extends to the method for manufacturing these elements.

A dual-polarization radiating element may be formed of two radiating dipoles, each dipole being constituted by two co-linear conductor strands. The length of each strand is roughly equal to one-quarter the working wavelength. The dipoles are mounted on a structure allowing them to be fed and to be positioned above a reflector (ground plane). This makes it possible, by reflecting the back-radiation of the dipoles, to refine the directivity of the radiation diagram of the assembly thereby formed. Depending on their orientation within space, the dipoles may radiate or receive electromagnetic waves along two polarization channels, for example, a horizontal polarization channel, and a vertical polarization channel, or two polarization channels oriented +/−45° compared to the vertical.

In order to construct a two-band antenna operating within two distinct frequency bands whose polarizations are orthogonal, two configurations are commonly employed.

The first method, called collinear (or concentric) consists of an alignment of radiating elements in which are concentrically disposed radiating elements formed by four dipoles disposed in a quadrature pattern, operating on a single frequency band, around radiating elements formed by two crossed dipoles operating on a single frequency band. The alignment is placed above the reflector within a single chassis.

The second method, known as "side by side" consists of a first alignment of radiating elements formed by two crossed orthogonal dipoles operating on a first frequency band and a second alignment of radiating elements formed by two crossed orthogonal dipoles operating on a second frequency band. The two rows are parallel and placed apart by a distance at least equal to a half-wavelength for the higher frequency band.

To improve the performance of such a two-band or multi-band antenna, it is necessary to increase the frequency bandwidth of each series of radiating elements, and simultaneously decrease the coupling between the rows of radiating elements. The decoupling between bands depends on the distance separating the radiating elements and on the relative orientation of the radiating elements with respect to one another. To improve the decoupling between two rows of elements placed within the same chassis, the following, as examples, have been proposed:

the use of two-band concentric elements, increasing the distance between elements separating two vertical alignments of radiating elements, in the so-called "side by side" configuration.

It has also been proposed to have radiating multi-band antenna elements comprising a dielectric mount with a high dielectric constant for the purpose of reducing the dimensions of the radiating element, onto which a layer of conductive material exhibiting a fractal pattern has been deposited.

Furthermore, in order to increase the frequency bandwidth of broadband antennas, solutions have been proposed such as a superimposing radiating elements or adding carefully positioned parasitic elements. One may also improve the system for feeding the elements or modify the geometric shape of the radiating elements themselves (spiral, periodic log, bowtie, etc.).

For example, the document U.S. Pat. No. 6,028,563 describes a dual-polarization radiating element formed of two crossed dipoles known as a "cross bowtie," placed on a foot resting on a reflector. Each dipole comprises radiating arms which are either negative or positive polarization, of a generally triangular shape. The radiating elements may be aligned to form an antenna.

The purpose of the present invention is to propose a non-concentric radiating element having a reduced size, the performance of the intent of being improved by a better decoupling of the radiating elements.

A further purpose of the invention is to propose a non-concentric radiating element operating over a broad frequency band, the performance of the intended being improved by expanding the frequency band.

A further purpose of the invention is to propose a broadband antenna comprising such an element.

The object of the present invention is a radiating element of a broadband antenna comprising a foot supporting first and second components disposed in a first plane which are two half-wavelength symmetrically fed dipoles generating a linear dual polarization and each comprising two arms, characterized in that the radiating element further comprises at least one third component chosen from among a dipole or a patch disposed within a second plane placed above the first plane, and in that each of the components is made up of a volume fractal pattern.

The main idea of the invention is to use the self-similarity property of fractal patterns in designing the geometry of the dipoles of a radiating element in order to reduce the size of the antenna, as the complexity of the fractal pattern is not altered by a change in scale. The general concept of fractal theory may be applied to an antenna's radiating elements, particularly to any shape of dipole (triangle, square, etc.) by using the principle of self-similarity in designing their structure. Iterating algorithms generate fractal objects in the form of digital images that may be constructed in the form of physical objects. In the present situation, on at least one surface of a half-dipole, a predetermined iterative pattern ("loop generator") is reproduced by applying the principle of self-similarity by machining, milling, etc.

One way to improve the bandwidth of the dipole is to use a fractal structure in three dimensions. Another way of improving the bandwidth of a radiating element is to vertically stack dipoles and potentially patches of similar or different sizes. Combining these two ways within the radiating element therefore leads to a radiating element with a small form factor that operates on a broad frequency band.

The arms of the dipoles are preferentially made of aluminium, brass, "zamac" (a zinc-based alloy) or a metallised polymer. The arms of the dipoles are preferentially milled.

In a first embodiment of the invention, the first, second, and third components disposed within the superimposed first and second planes are interconnected.

In a second embodiment, the first and second components disposed in the first plane are not interconnected with the third component disposed in the second plane which is superimposed onto it.

In one variant, the radiating element further comprises at least one additional component chosen from among a dipole or patch disposed within a third plane superimposed on the first and second planes. In one embodiment, the additional component is not interconnected with the dipoles of the first and second planes.

In another variant, the dipoles disposed within superimpose plans have a surface area that decreases the further they are from the reflector.

The two main basic techniques used for designing fractal radiating elements are as follows:

(a) the principle of geometric self-similarity enables identical operation within multiple Lo frequency bands, as the various parts of the dipole are similar to one another at different scales;

(b) increasing the complexity of the dipoles, which means using an iterative pattern to refashion the dipole's profile, may be used to reduce the size of the radiating element.

The combination of the refashioned profile and the self-similarity leads to antenna with a very broadband performance. It is understood that either of the two techniques may be used alone, or both may be used simultaneously. The techniques for designing fractal radiating elements are applied to the superimposed dipoles whether they are interconnected or not.

A further object of the invention is a broadband antenna comprising radiating elements aligned on a reflector, each one comprising a foot supporting first and second components disposed within a first plane which are two symmetrically fed half-wavelength dipoles generating a linear dual polarization and both comprising two arms, within which each radiating element further comprises at least one third component chosen from among a dipole or a patch disposed within a second plane placed above the first plan, and within which each of the components is made up of a volume fractal pattern.

In a second embodiment of the invention, the dipoles disposed within the first plane are positioned a quarter-wavelength away from the reflector plane, which serves as the mass plane.

A further object of the invention is a method for manufacturing a radiating element comprising a foot supporting first and second components disposed within a first plane which are two symmetrically fed half-wavelength dipoles generating a linear dual polarization, both comprising two arms, the method comprising a step of milling or a step of machining each of the components to achieve a volume fractal pattern.

One advantage of the present invention is enabling a reduction in the cost of manufacturing radiating elements while improving their RF performance and reducing their size.

Figure 2:
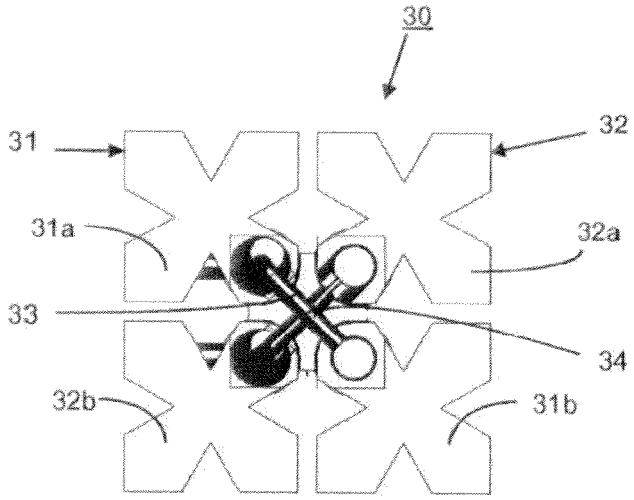
Figure 3:
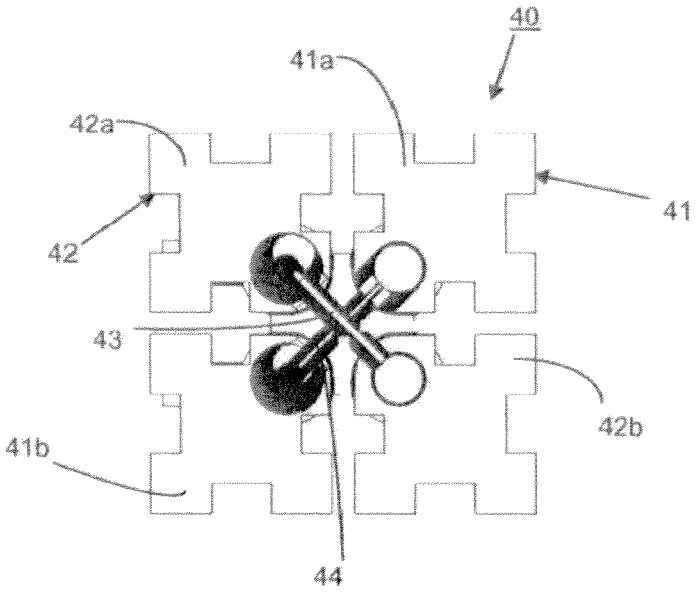
Figure 4:
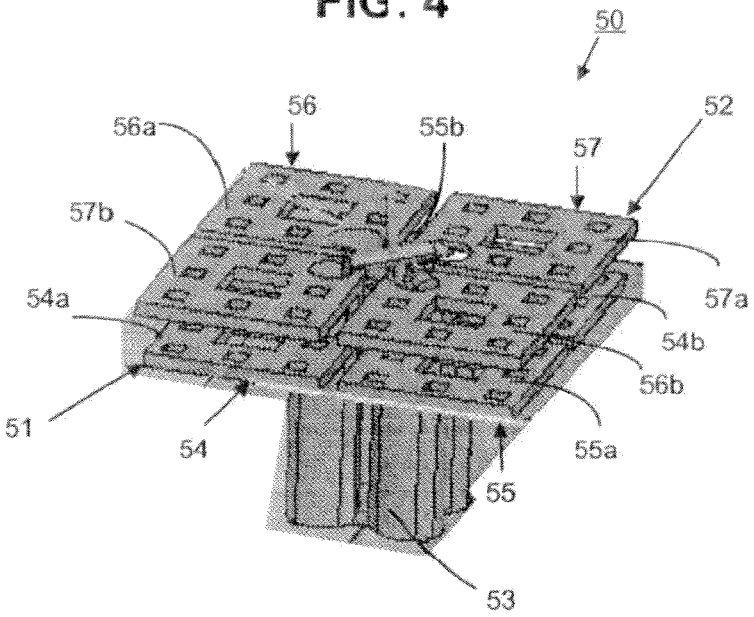
Figure 5:
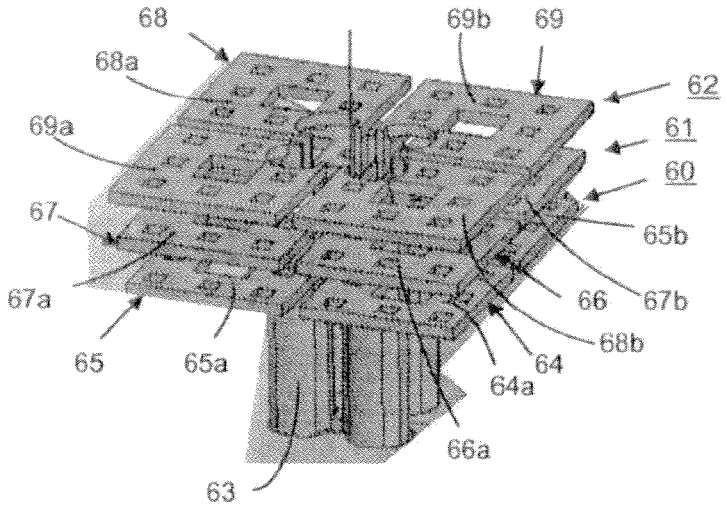
Figure 6:
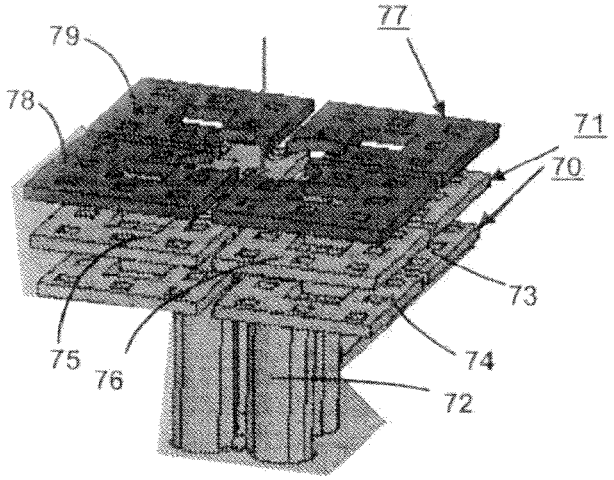
Figure 7:
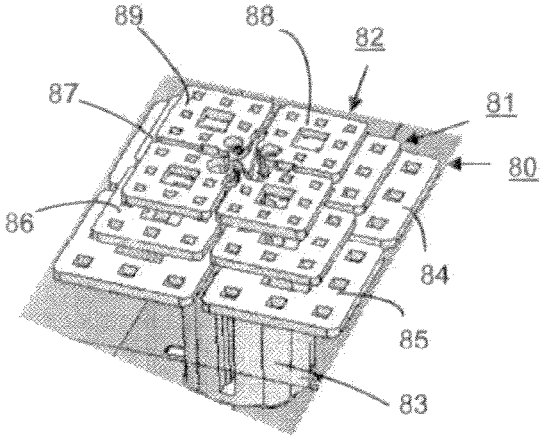
Figure 8:
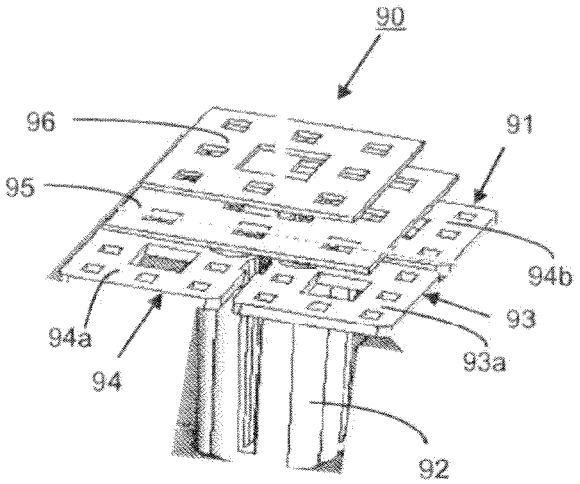

Other characteristics and advantages of the invention will become apparent while reading the following description of embodiments, which are non-limiting and given for purely illustrative purposes, and in the attached drawing, in which FIG. 1 shows a schematic top view of the first plane of a cross- and dual-polarization radiating element supporting dipoles constructed based on the "Cantor Slot Bow Tie" pattern, FIG. 2 shows a schematic top view of the first plane of a cross- and dual-polarization radiating element supporting dipoles constructed based on the Koch pattern, FIG. 3 shows a schematic top view of the first plane of a cross- and dual-polarization radiating element supporting dipoles constructed based on the Minkowski pattern, FIG. 4 shows a perspective view of a cross- and dual-polarization radiating element according to one embodiment of the invention, supporting two superimposed planes comprising interconnected dipoles constructed based on the Sierpinski carpet pattern, FIG. 5 shows a perspective view of a cross- and dual-polarization radiating element according to one embodiment of the invention, supporting three superimposed planes comprising interconnected dipoles constructed based on the Sierpinski carpet pattern, FIG. 6 shows a perspective view of a cross- and dual-polarization radiating element according to one embodiment of the invention, supporting three superimposed planes comprising dipoles constructed based on the Sierpinski carpet pattern, one of which is a director, FIG. 7 shows a perspective view of a cross- and dual-polarization radiating element according to one embodiment of the invention, supporting three superimposed planes comprising interconnected dipoles of decreasing size constructed based on the Sierpinski carpet pattern, FIG. 8 shows a perspective view of a cross- and dual-polarization radiating element according to one embodiment of the invention, supporting three superimposed planes comprising non-interconnected dipoles constructed based on the Sierpinski carpet pattern, FIG. 1 depicts a schematic example of the first plane of a radiating element 20 of the "bowtie" type. The radiating element 20 comprises two dipoles 21 and 22 whose respective arms 21*a*, 21*b* and 22*a*, 22*b* are triangular in shape. The principle of self-similarity has been applied to it, and leads to cross- and dual-polarization of a "Cantor Slot Bow Tie" radiating element. The two dipoles 21 and 22 are each equipped with a feed 23 and 24.

One technique that is used is characterized by the employment of an iterative pattern ("loop generator") to reduce the size of the dipole, while improving the RF performance of that dipole, in particular in terms of bandwidth. The two well-known iterative patterns in use are the Koch fractal and Minkowski fractal. The two resulting dipoles are respectively depicted in FIGS. 2 and 3.

The first plane of the radiating element 30 depicted in FIG. 2 comprises two dipoles 31 and 32. The two dipoles 31 and 32 are each equipped with a feed 33 and 34. Each dipole 31, 32 respectively comprises a first arm 31*a*, 32*a* and a second arm 31*b*, 32*b*, whose shape is obtained by iteration of the Koch fractal.

The first plane of the radiating element 40 depicted in FIG. 3 comprises two dipoles 41 and 42. The two dipoles 41 and 42 are each equipped with a feed 43 and 44. Each dipole 41, 42 respectively comprises a first arm 41*a*, 42*a* and a second arm 41*b*, 42*b* whose shape is obtained by iteration of the Minkowski fractal.

One way to improve the dipole's bandwidth is to use a fractal structure in three dimensions. Another way to improve the bandwidth of a radiating element is to vertically stack dipoles of similar or different sizes.

In a first embodiment of the invention, these dipoles may be electrically interconnected, as in FIGS. 4 and 5.

According to the embodiment depicted in FIG. 4, a radiating element 50 comprises dipoles placed within two superimposed planes 51 and 52 supported by a foot 53. The first plane 51 comprises two dipoles 54, 55 each a half-wavelength joined orthogonally in order to obtain a cross- and dual-polarization arrangement. Each dipole 54, 55 respectively comprises a first arm 54*a*, 55*a* and a second arm 54*b*, 55*b* along the length of one another. Each dipole 54, 55 is respectively provided with a feed balanced to generate a linear polarization. In the case depicted here, the principle of self-similarity has been applied to a square radiating, which leads to cross- and dual-polarization dipoles with the pattern of a volume (three-dimensional) Sierpinski carpet.

The first plane 51 is overlapped by a second plane 52 comprising two dipoles 56 and 57 each a half-wavelength joined orthogonally in order to obtain a cross- and dual-polarization arrangement. Each arm 56*a*, 56*b*, 57*m*. 57*b* of the dipoles 56 et 57 also exhibits a 3D Sierpinski carpet pattern.

FIG. 5 depicts a radiating element comprising interconnected dipoles disposed in three superimposed planes 60, 61 and 62, supported by a shared foot 63. The plane 60 comprises two dipoles 64, 65, each one a half-wavelength, orthogonally joined to obtain a cross- and dual-polarization arrangement. The planes 61 and 62 that overlap it respectively comprise two dipoles 66, 67 and 68, 69 in an analogous manner. Each arm 64*a*, 64*b*, 65*a*, 65*b* of the dipoles 64 and 65 exhibits a 3D Sierpinski carpet pattern. Likewise, each arm 66*a*, 66*b*, 67*a*, 67*b* of the dipoles 66 and 67 exhibits a volume Sierpinski carpet pattern. Likewise, each arm 68*a*, 68*b*, 69*a*, 69*b* of the dipoles 68 and 69 exhibits a volume Sierpinski carpet pattern.

In another embodiment, the dipoles disposed in different superimposed planes might also not be interconnected, as in FIG. 6. In this case, the dipole that is not interconnected is called the "director."

FIG. 6 depicts interconnected dipoles disposed in two superimposed planes 70 and 71 both supported by the same foot 72, each of the planes comprising two dipoles 73, 74 and 75, 76, each a half-wavelength, orthogonally joined to obtain a cross- and dual-polarization arrangement. Two other dipoles 78 and 79 that are not interconnected with the dipoles arranged in the planes 70 and 71 are called "directors." The two dipoles 78 and 79 have their arms disposed in the plane 77 superimposed atop the planes 70 and 71. Each dipole 73-76 and 78, 79 comprises two arms exhibiting a volume Sierpinski carpet pattern.

FIG. 7 depicts three superimposed planes 80, 81 and 82 whose dipoles are interconnected, with decreasing surface areas, supported by a shared foot 83. The resonance frequency of each plane's dipoles is slightly shifted, which increases the frequency bandwidth. The plane 80 comprises two dipoles 84, 85, each one a half-wavelength, orthogonally joined to obtain a cross- and dual-polarization arrangement. The planes 81 and 82 that overlap it respectively comprise two dipoles 86, 87 and 88, 89 in an analogous manner. Each arm of the dipoles 84-89 exhibits a volume Sierpinski carpet pattern.

FIG. 8 depicts an alternative embodiment comprising a radiating element 90 comprising a plane 91 supported by a foot 92 and comprising two dipoles 93 and 94 each having two arms 93*a*, 93*b* and 94*a*, 94*b* respectively, each arm exhibiting a volume Sierpinski carpet pattern. The plane 91 is overlapped by a patch disposed within a second plane 95, itself overlapped by a patch disposed within a third plane 96. The patches disposed in the planes 95 and 96 are not interconnected with the dipoles disposed in the plane 91 and are known as "directors." Each of the planes 95, 96 comprises a patch, or director, that is square, whose dimension, roughly equal to a half-wavelength, is shifted compared to the dimension of the dipoles placed within the plane 91 so as to increase the bandwidth of the radiating element. The patches or directors placed within the planes 95, 96 exhibit a 3D Sierpinski carpet pattern. As an advantage over other embodiments, this last configuration is easier to engineer.

An antenna according to an embodiment of the invention comprises a reflector supporting radiating elements analogous to those in FIG. 4. Each radiating element comprises a foot, two orthogonal dipoles placed in a first plane, and two orthogonal dipoles placed in a second plane. The respective arms of the four dipoles reproduce the Sierpinski carpet pattern in 3D. Radiating elements of a known type may also be added to the reflector, in which case the inventive antenna functions as a multi-band antenna, one band of which is a very broad band.

Naturally, the antenna may comprise radiating elements of all the previously described embodiments and their variants, and the inventive radiating elements may be implemented in any type of antenna regardless of its shape.

The invention claimed is:

1. A radiating element of a broadband antenna comprising a foot, disposed on an antenna reflector and supporting first and second components which are two half-wavelength symmetrically fed dipoles generating a linear dual polarization, both comprising two arms, wherein the first and second components are disposed in a first plane, wherein the radiating element further comprises at least one third component chosen from among a dipole or a patch disposed within a second plane placed above and parallel to the first plane, and wherein each of the components is made up of a volume fractal pattern.

2. A radiating element according to claim 1, wherein the arms of the dipoles are preferentially made of aluminium, brass, zamac, or a metallised polymer.

3. A radiating element according to claim 1, wherein the first, second, and third components disposed within the superimposed first and second planes are interconnected.

4. A radiating element according to claim 3, further comprising at least one additional component chosen from among a dipole or patch disposed within a third plane superimposed parallel to first and second planes.

5. A radiating element according to claim 4, wherein the additional component is not interconnected with the dipoles disposed in the first plane.

6. A radiating element according to claim 3, wherein the dipoles disposed within superimpose plans have a surface area that decreases the further they are from the reflector.

7. A radiating element according to claim 1, wherein the first and second components disposed within the first plane are not interconnected with the third component disposed within the second plane which is superimposed onto it.

8. A broadband antenna comprising radiating elements aligned on a reflector, each radiating element comprising a foot disposed on an antenna reflector and supporting first and second components which are two half-wavelength symmetrically fed dipoles generating a linear dual polarization, both comprising two arms, wherein the first and second components are disposed in a first plane, wherein the radiating element further comprises at least one third component chosen from among a dipole or a patch disposed within a second plane placed above and parallel to the first plane, and wherein each of the components is made up of a volume fractal.

9. A broadband antenna according to claim 8, wherein the dipoles disposed within the first plane are positioned a quarter-wavelength away from the reflector plane, which serves as the ground plane.

10. A method for manufacturing a radiating element comprising a foot disposed on an antenna reflector and supporting first and second components which are two half-wavelength symmetrically fed dipoles generating a linear dual polarization, both comprising two arms, wherein the first and second components are disposed in a first plane, wherein the radiating element further comprises at least one third component chosen from among a dipole or a patch disposed within a second plane placed above and parallel to the first plane, and wherein each of the components is made up of a volume fractal pattern wherein the method comprises a stop of milling or machining each of the components to achieve the volume fractal pattern.

* * * * *